US006473048B1

(12) United States Patent
Diaz

(10) Patent No.: US 6,473,048 B1
(45) Date of Patent: Oct. 29, 2002

(54) FREQUENCY SELECTIVE MICROWAVE DEVICES USING NARROWBAND METAL MATERIALS

(75) Inventor: Rodolfo E Diaz, Phoenix, AZ (US)

(73) Assignee: Arizona Board of Regents, Tempe, AZ (US)

( * ) Notice: Subject to any disclaimer, the term of this patent is extended or adjusted under 35 U.S.C. 154(b) by 0 days.

(21) Appl. No.: 09/830,039

(22) PCT Filed: Nov. 3, 1999

(86) PCT No.: PCT/US99/25904

§ 371 (c)(1),
(2), (4) Date: Jul. 9, 2001

(87) PCT Pub. No.: WO00/33414

PCT Pub. Date: Jun. 8, 2000

Related U.S. Application Data

(60) Provisional application No. 60/106,789, filed on Nov. 3, 1998, and provisional application No. 60/107,921, filed on Nov. 10, 1998.

(51) Int. Cl.[7] ..... H01Q 15/02

(52) U.S. Cl. ..... 343/753; 343/909; 343/910; 343/911 R

(58) Field of Search ..... 343/700 MS, 753, 343/754, 872, 909, 910, 911 L, 911 R; H01Q 15/02, 15/24

(56) References Cited

U.S. PATENT DOCUMENTS

| | | | | |
|---|---|---|---|---|
| 2,956,281 A | * | 10/1960 | McMillan et al. | 343/872 |
| 3,633,206 A | | 1/1972 | McMillan | 343/754 |
| 3,959,796 A | | 5/1976 | Merkel et al. | 343/909 |
| 4,467,330 A | * | 8/1984 | Vidal et al. | 343/872 |
| 4,480,256 A | * | 10/1984 | Wren | 343/909 |

(List continued on next page.)

FOREIGN PATENT DOCUMENTS

| | | |
|---|---|---|
| GB | 2236019 | 3/1991 |
| WO | 9007199 | 6/1990 |
| WO | 9827025 | 6/1998 |

OTHER PUBLICATIONS

Kyriazidou et al., "Novel Material with Narrow–Band Transparency Windonw in the Bulk", IEEE Transactions on Antenna and Propagation, vol. 18, No. 1, pp. 107–116, Jan. 2001.

*Primary Examiner*—Tho Phan
(74) *Attorney, Agent, or Firm*—Baker Botts L.L.P.

(57) ABSTRACT

A microwave device operating at a selected frequency band or group of selected frequency bands of interest includes a resonant bulk material having one or more conductivity bandwidths corresponding to the selected frequency band or group of selected frequency bands of interest. The resonant bulk material exhibits conductive properties at a frequency or frequencies within the one or more conductivity bandwidths and non-conductive properties at all other frequencies, and includes a narrowband metal material having a Lorentz resonance frequency or frequencies within the selected frequency band or group of selected frequency bands of interest. In a preferred embodiment, the resonant bulk material includes lossy material particles arranged for absorbing radiation at the frequency or frequencies within the one or more conductivity bandwidths; and a resonant coating of the narrowband metal material coating around the lossy material particles, the coating having a Lorentz resonance frequency or frequencies within the selected frequency band or group of selected frequency bands of interest. Alternatively, the resonant bulk material can be used to construct wave guiding or wave scattering devices. The resonant bulk material is especially advantageous for use in a variety of highly transmissive and highly conductive microwave devices including but not limited to antennas, frequency converters and extremely narrowband filters/couplers.

14 Claims, 11 Drawing Sheets

U.S. PATENT DOCUMENTS 4,507,664 A 3/1985 James et al. ..... 343/700
5,063,389 A * 11/1991 Reits ..... 342/359
5,103,239 A 4/1992 Verzemnieks et al. ..... 343/872
5,385,623 A 1/1995 Diaz ..... 156/197
5,661,484 A 8/1997 Shumaker et al. ..... 342/1
5,662,982 A 9/1997 Diaz ..... 428/116
5,721,551 A * 2/1998 Tran et al. ..... 342/1

* cited by examiner

FREQUENCY SELECTIVE MICROWAVE DEVICES USING NARROWBAND METAL MATERIALS

This application claims the benefit of provisional applications Serial No. 60/106,789 filed Nov. 3, 1998 and Ser. No. 60/107,921 filed Nov. 10, 1998. PCT application No. PCT/US99/25904 was published in English under publication number WO 00/33414 on Jun. 8, 2000. The present invention relates in general to the field of microwave devices and artificial dielectrics.

BACKGROUND OF INVENTION

1. Field of the Invention

The present invention relates in general to the field of microwave devices and artificial dielectrics. More particularly, the present invention relates to the design and fabrication of highly transmissive and conductive frequency selective microwave devices using a resonant bulk material.

2. Background of the Invention

In applications ranging from commercial "antenna farms" to military airborne active radars, the coupling of radiating structures to electromagnetic frequencies outside the desired frequency band or bands of operation remains a critical design limitation. In commercial communications applications, for example, high gain dish antennas must be encased in absorbing shrouds or radomes to prevent cross-coupling and interference with neighboring antennas broadcasting or receiving signals at different frequencies. In tactical aircraft, radars having a flat-plate array geometry for achieving high gain characteristics also makes such radars good scatterers of radiation at all other frequencies, particularly at frequencies above the active band of the radars.

Various solutions have been used to minimize the effects of cross-coupling in microwave devices, including Frequency Selective Surfaces (FSS's), high performance tuning of the array, absorber loading and high squint angles, but all add complexity and cost to the system. FSS technology, for example, is notoriously difficult to adapt to complex geometries. such as aircraft radomes, and is also characterized by undesired out-of-band grating lobes. Other alternatives, such as Photonic Band Gap (PBG) materials, require complex and costly manufacturing techniques and very strict design and manufacturing tolerances.

As such, materials having a "tuned electromagnetic window," obtained in bulk through chemical means and standard composite manufacturing processes, would present a cost effective solution to this problem. Frequency selective materials of two complementary types, judiciously applied to the above-described engineering problems would allow antennas and other microwave devices operating in different frequencies to share "real estate" with a minimal mutual coupling. Advantageously, a first type of such materials would remain opaque over most of a broad frequency band but transparent over a narrow frequency band window within the broad band, and a second type would remain transparent over most of a broad frequency band but highly reflective over a narrow frequency range within the broad band.

SUMMARY OF THE INVENTION

Therefore, a principal object of the present invention is to provide a variety of novel microwave devices that utilize bulk materials, such as narrow band metals (NARMET's), having a "tuned electromagnetic window" dependent on the electromagnetic characteristics of the material. A NARMET is herein defined as a condensed material, liquid or solid, whose permittivity exhibits a single sharp Lorentz resonance, i.e., a high Q, at a particular frequency or set of frequencies in the electromagnetic spectrum. It will be apparent to those skilled in the art that various microwave devices may be designed, tuned and manufactured for use in the diverse environments that exploit the resonance characteristics of NARMET materials.

More specifically, another object of the present invention is to provide a bulk material that is highly transmissive over a narrow band of desired frequencies. Such a material acts as an electromagnetic absorber over most of a broad frequency band while remaining electromagnetically transparent over a narrow band of desired frequencies with the broad band.

Still another object of the present invention is to provide a bulk material that is highly conductive over a narrow band of desired frequencies and thus behaves as a metal only with the desired frequency band. Such material is thus conductive and reflective over the narrow band of desired frequencies while remaining electromagnetically transparent at all other frequencies.

Hence, a class of microwave devices is disclosed that substantially overcomes the aforedescribed limitations and inadequacies of conventional microwave devices. A microwave device operating at a selected frequency band or group of selected frequency bands of interest is provided, for example, that is constructed and arranged using a resonant bulk material. The resonant bulk material includes a narrowband metal material having one or more conductivity bandwidths defined by one or more Lorentz resonance frequencies within the selected frequency band or group of selected frequency bands of interest. Accordingly, the narrowband metal material exhibits conductive properties at a frequency or frequencies within the one or more conductivity bandwidths and non-conductive properties at all other frequencies.

In another preferred embodiment, the resonant bulk material includes a dielectric matrix of lossy particles coated with the narrowband metal material, preferably liquid metal-ammonia. The coated particles are used to form highly transmissive microwave devices that absorb radiation at frequencies outside the one or more conductivity bandwidths of the narrowband metal material.

Alternatively, the resonant bulk material includes narrowband metal material is used to construct a variety of substructures that are used as part of wave guiding or wave scattering devices. Preferably, when the substructures are comparable in size, i.e., on the order of one-half the wavelength of the desired frequency or frequencies, the resonance of the device is enhanced.

Further objects, features and advantages of the invention will become apparent from the following detailed description taken in conjunction with the accompanying figures showing illustrative embodiments of the invention.

BRIEF DESCRIPTION OF THE DRAWINGS

For a complete understanding of the present invention and the advantages thereof, reference is now made to the following description taken in conjunction with the accompanying drawings in which like reference numbers indicate like features and wherein.

While the subject invention will now be described in detail with reference to the figures, it is done so in connection with the illustrative embodiments. It is intended that changes and modifications can be made to the described embodiments without departing from the true scope and spirit of the subject invention as defined by the appended claims.

DETAILED DESCRIPTION OF THE PREFERRED EMBODIMENTS

Figure 1A:
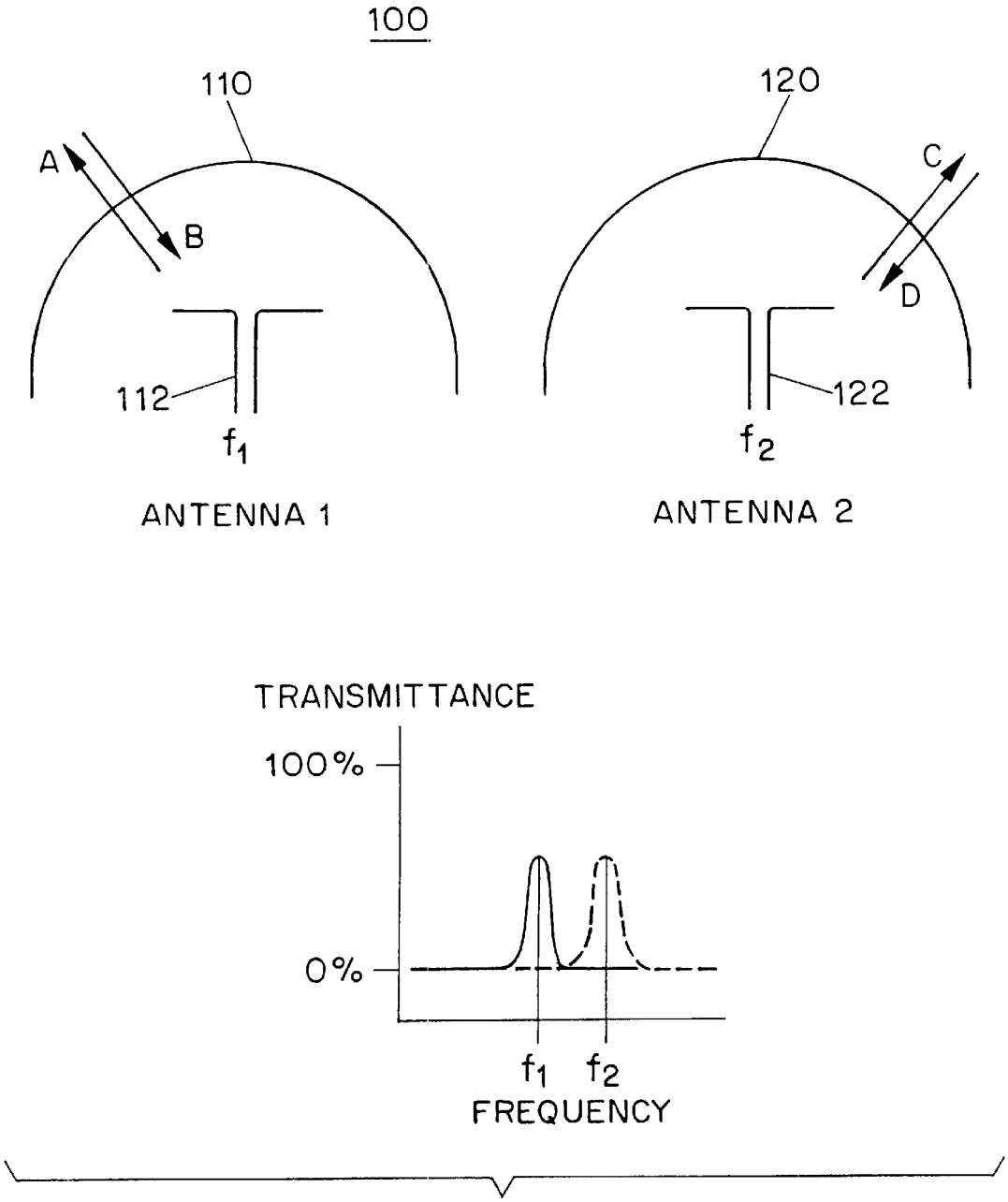
FIGS. 1A and 1B are illustrations of highly transmissive and highly conductive microwave devices, respectively, according to preferred embodiments of the present invention.
Figure 1B:
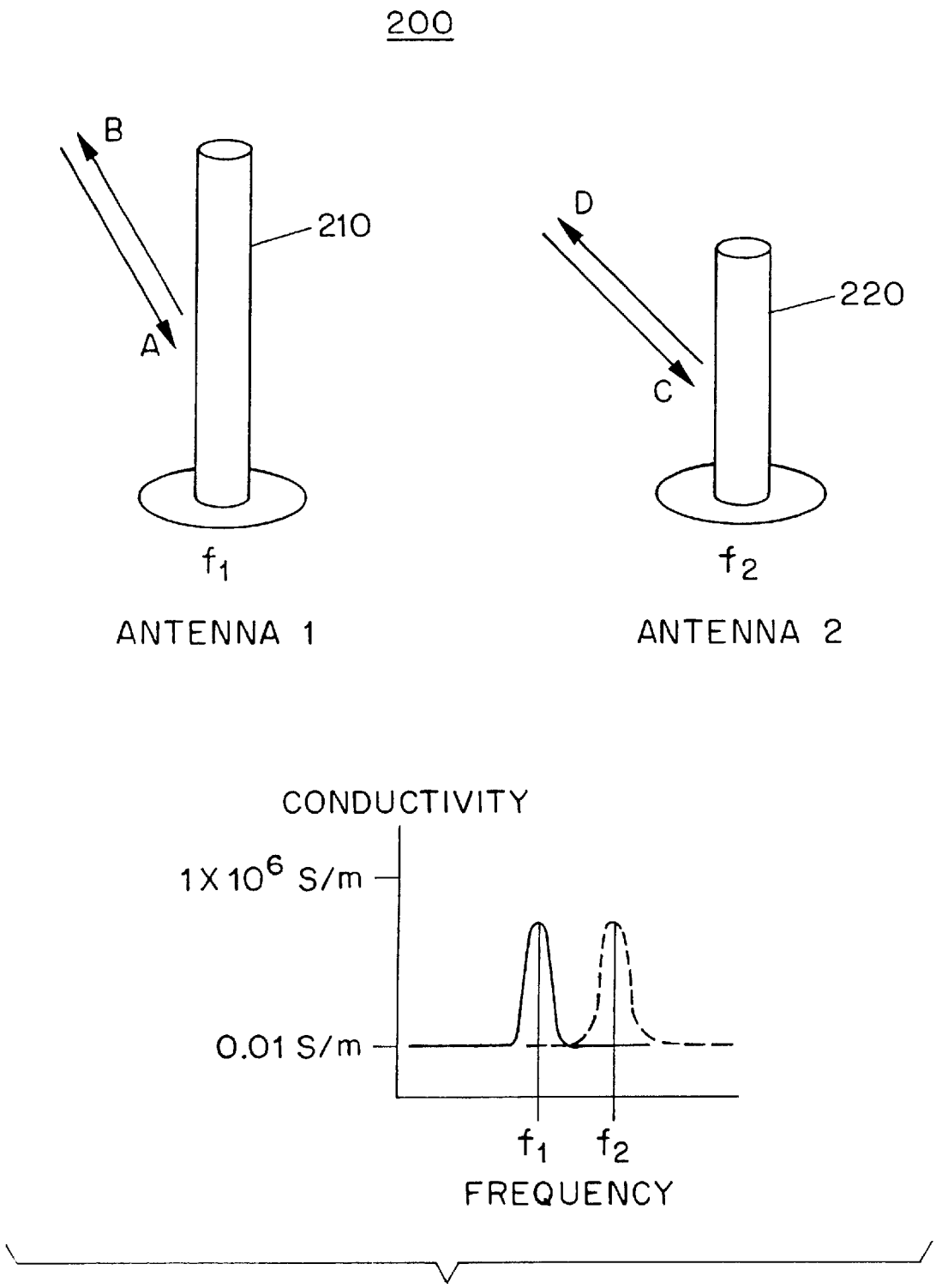

FIGS. 1A and 1B illustrate examples of the general categories of microwave devices of the present invention. FIG. 1A shows an example of a "highly transmissive" microwave device, and FIG. 1B shows an example of a "highly conductive" microwave device. Highly transmissive devices, such as the radomes 110 and 120 of FIG. 1A, are devices that allow signals at a selected frequency or frequencies, e.g., signals A and B at frequency $f_1$ to pass through radome 110, while effectively blocking all other undesired frequencies, e.g, signals C and D at frequency $f_2$ at radome 110. The converse is thus true for radome 120. Such devices thus appear transparent to signals within a selected frequency band or group of frequency bands, while acting as barriers to signals at frequencies outside the selected frequency band or group of frequency bands. The highly conductive devices shown in FIG. 1B are those devices that respond as metals, in a conductive and reflective sense, only within the selected frequency band or group of frequency bands. Therefore, as shown by way of example in FIG. 1B, dipole antenna 210 is designed to transmit and receive only signals A and B at frequency $f_1$, and dipole antenna 220 is designed to transmit and receive only signals C and D at frequency $f_2$.

Figure 2:
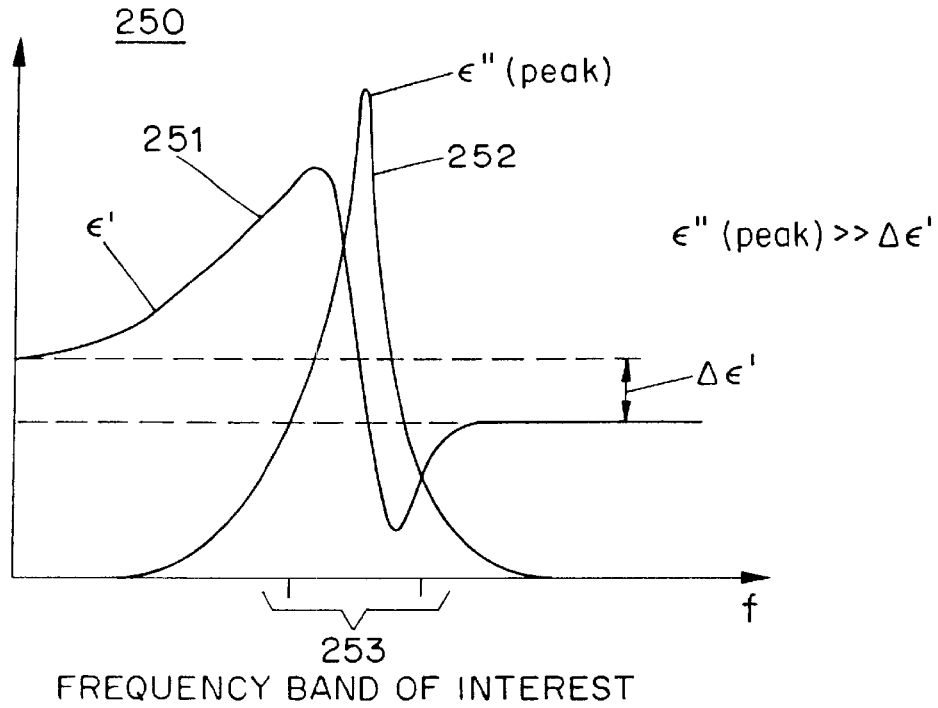
FIG. 2 is plot showing the Lorentz resonance characteristics of a narrowband metal material in accordance with the present invention.

In accordance with a principal aspect of the present invention, both types of devices shown in FIGS. 1A and 1B include a NARMET material arranged in various configurations as described below. A NARMET material in accordance with the present invention is a condensed material, liquid or solid, having a very sharp Lorentz resonance (high Q) in a frequency range of interest such that the peak value of the imaginary part of its permittivity, which is equivalent to a high electrical conductivity, is greater than or equal to 100 S/m. The Lorentz resonance of such a material, as shown in FIG. 2, is characterized by a peak imaginary permittivity $\in''$ 252 that is much greater than the net drop in the real permittivity $\in'$ 251 within a desired frequency range 253. See, e.g., R. E. Diaz and N. G. Alexopoulos, "*An Analytic Continuation Method for the Analysis and Design of Dispersive Materials*", IEEE Trans. Antennas and Propagation, Vol. 45, No. 11, pp. 1602–1610 (Nov. 1997). The mathematical expression for this characteristic of NARMET materials is shown by Equation (1):

$$\sigma=\omega\in_0\in'' \qquad \text{Equation (1)}$$

wherein $\sigma$ is the conductivity of the NARMET material, $\in_0$ is the permittivity of free space ($8.854*10^{-12}$ F/m) and $\in''$ is the relative imaginary permittivity of the NARMET material.

Thus, since a very high $\in''$ is equivalent to high conductivity over a relatively narrow frequency band in accordance with the Lorentz resonance properties of the material, the NARMET material behaves as an electrical conductor over a relatively narrow band of frequencies. Such material, either intrinsically or through chemical processing, can be selectively "tuned" so as to electrically conduct only over a selected frequency band or group of frequency bands. The NARMET material is thus characterized by a conductivity bandwidth, which is defined as the ratio of the frequency range over which the conductivity changes by one-half relative to the peak value divided by the frequency at which the peak value occurs. The conductivity bandwidth is typically in the range of 0.001 to 0.5, but preferably on the order of 0.1. Preferably, the NARMET has a center frequency of its conductivity bandwidth within the microwave range, and more specifically within the range of 100 MHZ to 40 GHz.

Thus, for constructing "highly transmissive" devices, resistive substructures, each typically much smaller then the wavelength of interest, is coated with the narrowband metal and then arranged in an ordered or random array of coated substructures to obtain a composite material that exhibits a desired effective permittivity. Outside the resonance of the NARMET, the resistive substructures are free to interact with an electromagnetic wave propagating through the composite material. As a result, the energy of the wave is absorbed and the material is an attenuating, absorbing or opaque medium. However, at the Lorentz resonance frequency of the NARMET, the high conductivity of the coatings shield the resistive substructures thus their lossy characteristics are unavailable to the electromagnetic wave, allowing the electromagnetic wave to propagate essentially unattenuated through the ordered or random array of coated substructures.

For constructing "highly conductive" devices that are highly conductive or reflective, the NARMET material is used to construct substructures that are comparable in size, in at least one linear dimension, to within one-quarter to one-half the wavelength of the desired frequency band. When such substructures are used in isolation or in combination, they are essentially transparent outside the Lorentz resonance, but become highly reflecting at the Lorentz resonance frequency of the NARMET material.

In accordance with a preferred embodiment of the present invention, a NARMET material can be used to construct a "lossy" medium, e.g., a baseline Debye absorber material, in which lossy particles are individually coated with a Lorentz resonant coating or layer. See U.S. Pat. Nos. 5,385,623 and 5,662,982. The term "lossy" is known and understood to refer to a medium that absorbs radiation therethrough. The resulting composite material has a dielectric constant that is characterized by loss over most of the spectrum except for a narrow frequency band of transparency prescribed by the parameters of the scatterers and the coating. See R. E. Diaz and N. G. Alexopoulos, "*An Analytic Continuation Method for the Analysis and Design of Dispersive Materials*", IEEE Trans. Antennas and Propagation, Vol. 45, No. 11, pp.1602–1610 (Nov. 1997). Depending upon the electromagnetic properties of the resonant coating, frequency selective materials can be designed to operate in one or more desired frequency bands.

Figure 3:
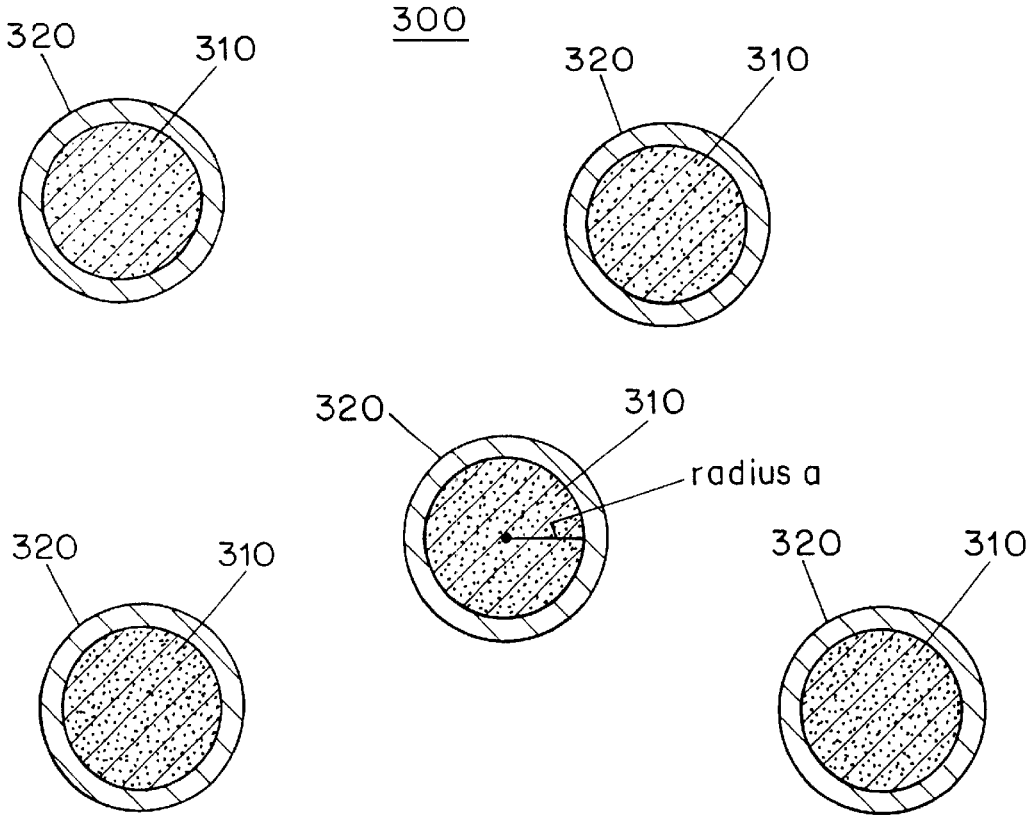
FIG. 3 is a cross-sectional view of a spherical lossy particles coated with a narrowband metal in accordance with a preferred embodiment of the present invention.

FIG. 3 shows a cross-sectional view of multiple spherical lossy particles 310, e.g., carbon particles, coated with a narrowband metal 320 in accordance with a preferred embodiment of the present invention. The number and arrangement of the lossy particles are shown by way of example and not limitation. Each of the lossy particles 310, which may have shapes other than a spherical shape, are shown in FIG. 3 as having a lossy resistive core characterized by a radius $\alpha$ and conductivity $\sigma$, and a resonant (Lorentz) coating 310 having a thickness t. The resonant coating is preferable encapsulated or formed into as solid around each of the lossy particles. As further shown in FIG. 3, the particles 310 with NARMET coatings 320 are randomly dispersed in a dielectric matrix to form the resonant bulk layer of the present invention.

The resonant coating is preferably a coating of metal-ammonia solution, preferably an alkali metal-ammonia solution in the 0.5 to 1.5 metal percent molar (MPM) range at −40° C. Such a solution has been shown to be conductive or frequency selective in the commercial and military frequency ranges, namely 2 GHz to 20 GHz namely at 10 GHz. In particular, the metal-ammonia solution has been shown to have a Lorentz resonance at a frequency of 10 GHz. See K. G. Breitschwerdt, H. Radscheit, "*Microwave Resonant Absorption in Metal-ammonia Solutions*", Physics Letters, 50A(6), pp. 423–424 (Jan. 1975). Metal-ammonia is advantageous in that it can be formed using naturally occurring materials and thus provides a cost effective alternative to synthesized materials having the same characteristics. Further, refrigeration at −40° C. can be accomplished by ordinary approaches such as electro-refrigeration or liquid nitrogen refrigeration, which is commonly used as a calibration standard and a means to improve signal to noise ratio in infrared sensor electronics. However, any other natural or synthetic material, such as carborane, possessing a Lorentz resonance may likewise by employed. See, e.g., U.S. Pat. No. 5,317,054.

To construct a radome for the device shown in FIG. 1A, for example, consider again the coated lossy particle shown in FIG. 3. The coated lossy particle of FIG. 3 is one of N particles dispersed in a dielectric matrix at a volume fraction $\rho$. Since the Lorentz coating on the particle is thin and narrow-band in frequency, it does not contribute to the polarizability of the particle over most of the spectrum and the medium exhibits relaxation behavior given by the Clausius-Mossotti expression of Equation (2):

$$\varepsilon_{eff} = \varepsilon_{matrix}\left(\frac{1+2\rho_1}{1-\rho_1}\right) \qquad \text{Equation (2)}$$

wherein the derated volume fraction $\rho_1$ is expressed by Equation (3):

$$\rho_1 = \rho\left(\frac{\varepsilon_{inc} - \varepsilon_{matrix}}{\varepsilon_{inc} + \varepsilon_{matrix}}\right) \qquad \text{Equation (3)}$$

and $\in_{inc}$ is the particle's complex relative permittivity, while $\in_{matrix}$ is the relative permittivity of the matrix material.

Figure 4:
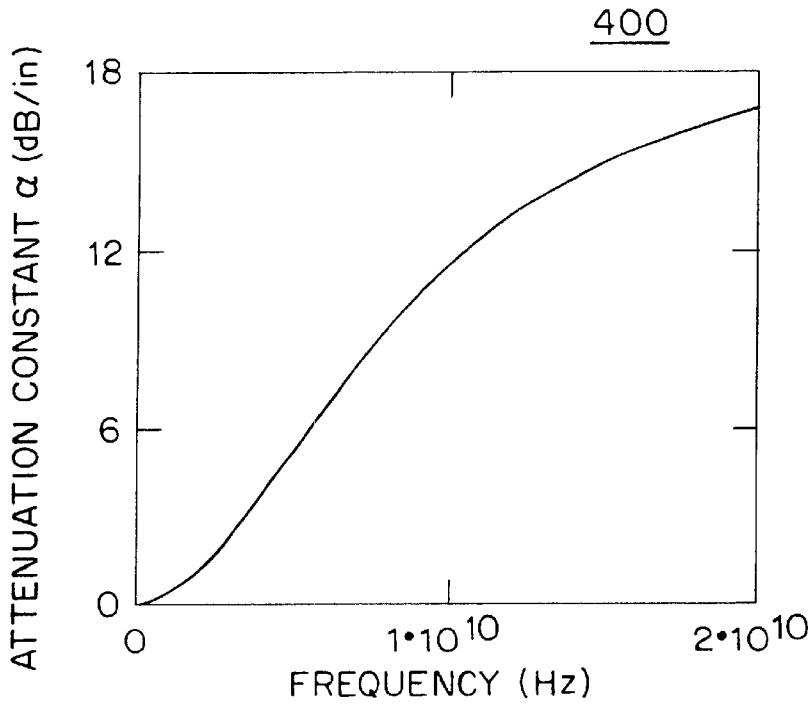
FIG. 4 is a plot of the attenuation constant versus frequency characteristics of a typical baseline Debye absorber material resulting from a dispersion of lossy particles in a dielectric host matrix.

FIG. 4 shows a plot of the loss (attenuation constant $\alpha$ in dB/in) versus frequency (Hz) characteristics of a typical baseline Debye material having a matrix of dielectric constant 3 (typical resin) and uncoated resistive particles. For this example, the volume fraction p has been assumed to be 20%, low enough that the Clausius-Mossotti expression is known and assumed to be valid. As shown in FIG. 4, this baseline Debye material has an attenuation constant on the order of −11 dB/in to −14 dB/in from 10 to 13 GHz. Therefore, with no resonant coating, the attenuation constant of the baseline Debye material monotonically increases over the entire frequency band of interest, e.g., 10 to 13 GHz.

However, with a NARMET material serving as a Lorentz coating, the resonance characteristics of the coating allows the coating to become extremely lossy, that is, extremely conductive within the desired frequency band. If the resonant coating is conductive enough, the resonant coating will mask the resistive core of the lossy particles and therefore the material will behave as a low loss artificial dielectric. Accordingly, a "transparency window" is formed in the neighborhood of the Lorentz resonance frequency for the NARMET device.

Figure 6:
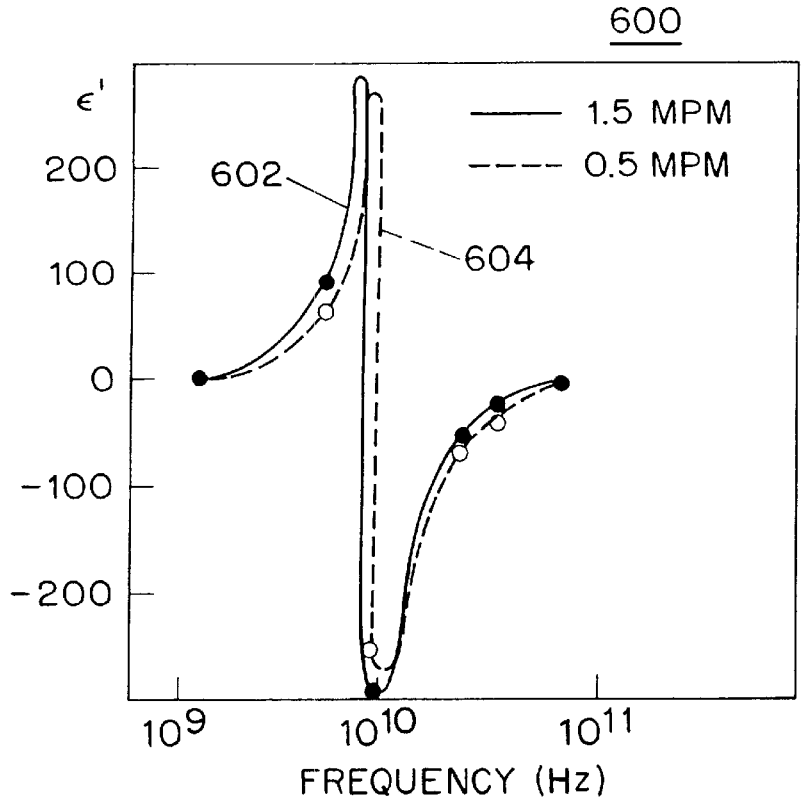
FIG. 6 is a plot of the Lorentz resonant permittivity (real part) versus frequency characteristics for the lossy particles of FIG. 3 coated with a liquid metal-ammonia NARMET material.
Figure 5A:
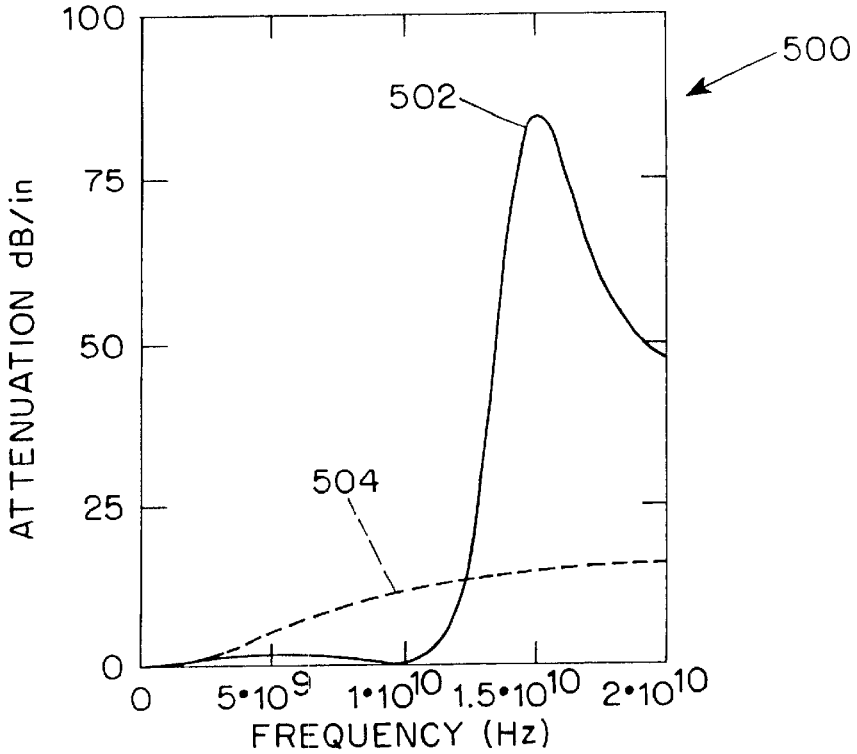
FIGS. 5A and 5B are plots of the attenuation constants for the same absorber material of FIG. 4 except that the lossy particles are coated with a liquid metal-ammonia narrowband metal material.
Figure 5B:
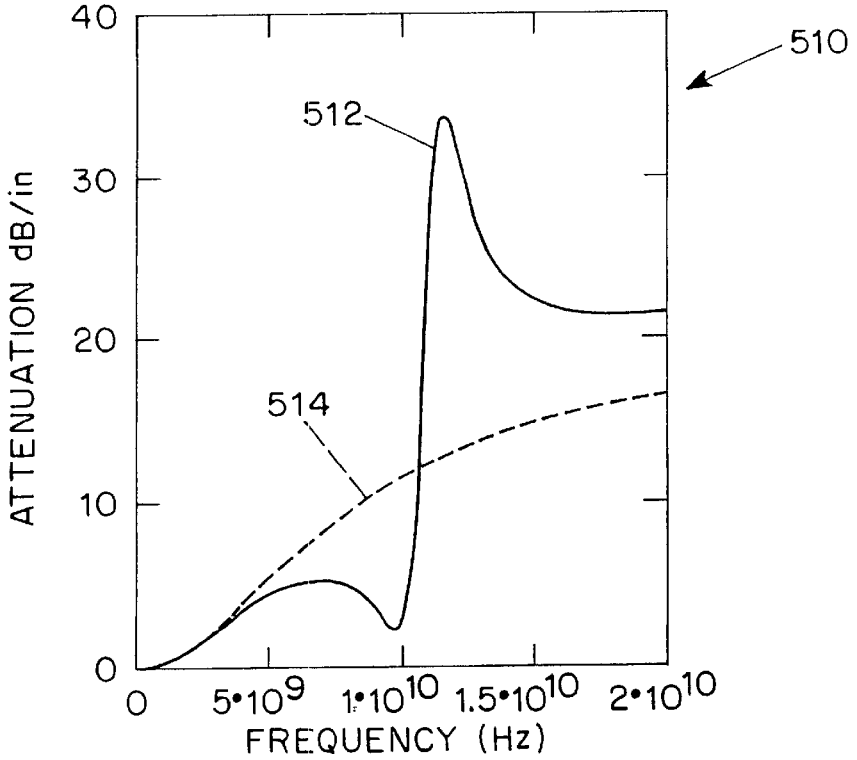

FIGS. 5A and 5B show a plots of the attenuation constant in dB/in for the same baseline Debye particle coated with a metal-ammonia ($Li—NH_3$) liquid resonant coating having the permittivity characteristics shown in FIG. 6, which shows a plot of the real part of the permittivity for an $Li—NH_3$ solution at 238 K. From this data, the imaginary part of the permittivity $\in''$ was calculated through the analytic continuation method developed by Diaz and Alexopoulos. See R. E. Diaz and N. G. Alexopoulos, "*An Analytic Continuation Method for the Analysis and Design of Dispersive Materials*", IEEE Trans. Antennas and Propagation, Vol. 45, No. 11, pp.1602–1610 (Nov. 1997). Referring to FIG. 5A and 5B, the solid lines 502 and 512 show the attenuation constants for a composite material using NARMET (coated) particles, and the dashed lines 504 and 514 show the attenuation constants for a material with the uncoated baseline particles. The coating in FIG. 5A is thick, approximately 0.5 times the radius of the baseline particle, and the coating in FIG. 5B is thin, approximately 0.1 times the radius of the baseline particle. Referring again to FIG. 5A, the result is a sharp lowpass filter behavior, with an attenuation of 0.77 dB/in at 9.7 GHz that rapidly increases to 10 dB/in at 12 GHz and is approximately equal to 36 dB/in at 13 GHz. In FIG. 5B the attenuation is approximately 2.35 dB/in at 10 GHz, 10 dB/in at 11 GHz and 5 dB/in at 7 GHz. The size of the conductivity bands of the NARMET material however can be varied depending upon Lorentz resonance of the resonant coating.

Figure 7A:
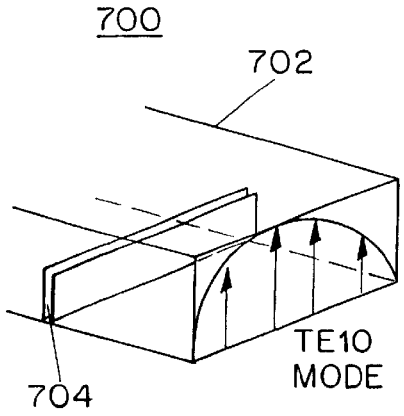
FIGS. 7A and 7B are perspective and cross-sectional views, respectively, of a capacitive iris arranged within an X-band waveguide used to model the effects of the resonant coating of the present invention.
Figure 7B:
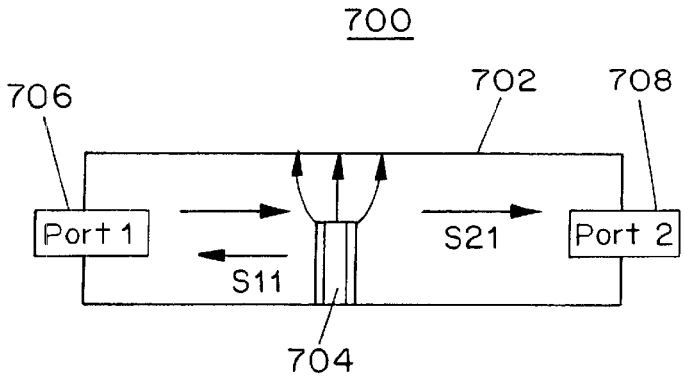

The effects of the Li—$NH_3$ solution on the width and depth of the conductivity bands or transparency windows have been studied using a waveguide mock-up of the NARMET material. FIGS. 7A and 7B show perspective and cross-sectional views, respectively, of a mock-up of a capacitive iris 704 arranged in an X-band waveguide 702 used to model the effects of the resonant coating of the present invention. Ports 1 and 2, 706 and 708 respectively, are coupled to opposing ends of the waveguide 702. The capacitive iris 704 includes a resistive cup filled with a metal-ammonia solution. S11 and S21 denote the reflections and insertion loss measurements, respectively, taken to derive the waveguide's frequency dependant capacitance C(f).

A similar capacitive iris arranged in an X-band waveguide, without the metal-ammonia solution, has been used to calculate the effective admittance that a conductive strip offers a wave in free space, and the effective permittivity of an artificial dielectric strip medium. Such an iris is a shunt capacitive obstacle and its capacitance is expressed by Equation (3):

$$C_0 = y_0 \frac{2\varepsilon_0 b}{\pi} \ln\csc\left(\frac{\pi b'}{2b}\right) \qquad \text{Equation (3)}$$

where b is the height of the waveguide and b' is the size of the gap over the strip, and $y_0$ is the normalized admittance of the waveguide's TE10 mode (in the order of 1.0) When the strip is resistive, this capacitance is in series with the resistance of the strip, R, yielding an effectively frequency-dependent capacitance given by:

$$C(f) = C_0 \frac{1}{1 + j\omega RC} \qquad \text{Equation (4)}$$

which clearly exhibits a Debye relaxation behavior with a conductance (loss) that increases monotonically with frequency.

Figure 8A:
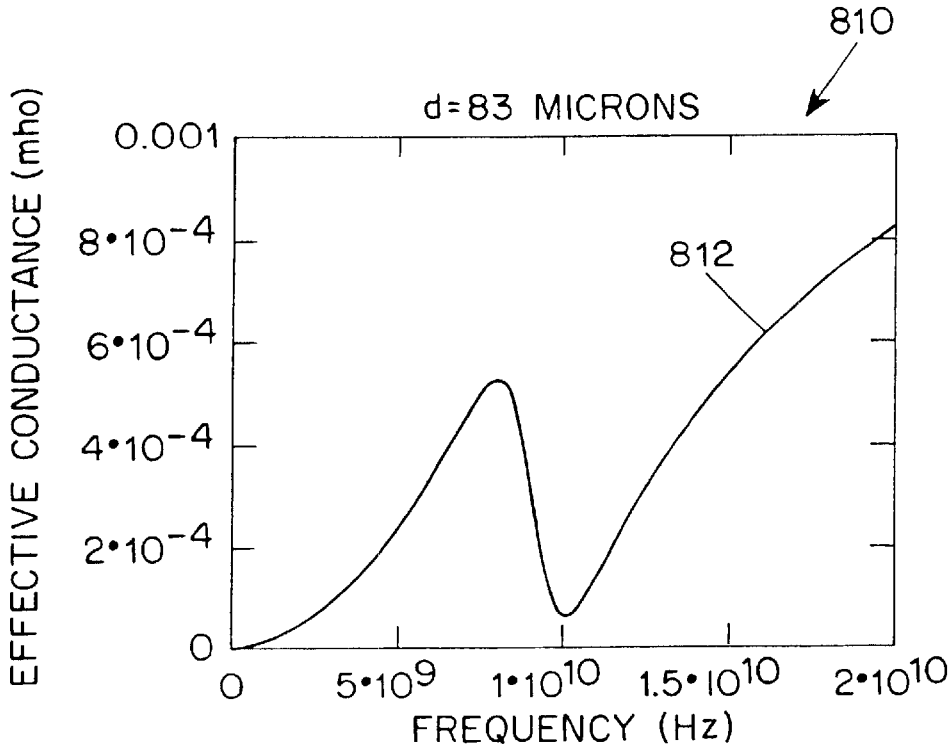
FIGS. 8A and 8B are plots of the calculated effective conductance of the capacitive iris of FIGS. 7A and 7B when filled with a liquid metal-ammonia NARMET material.
Figure 8B:
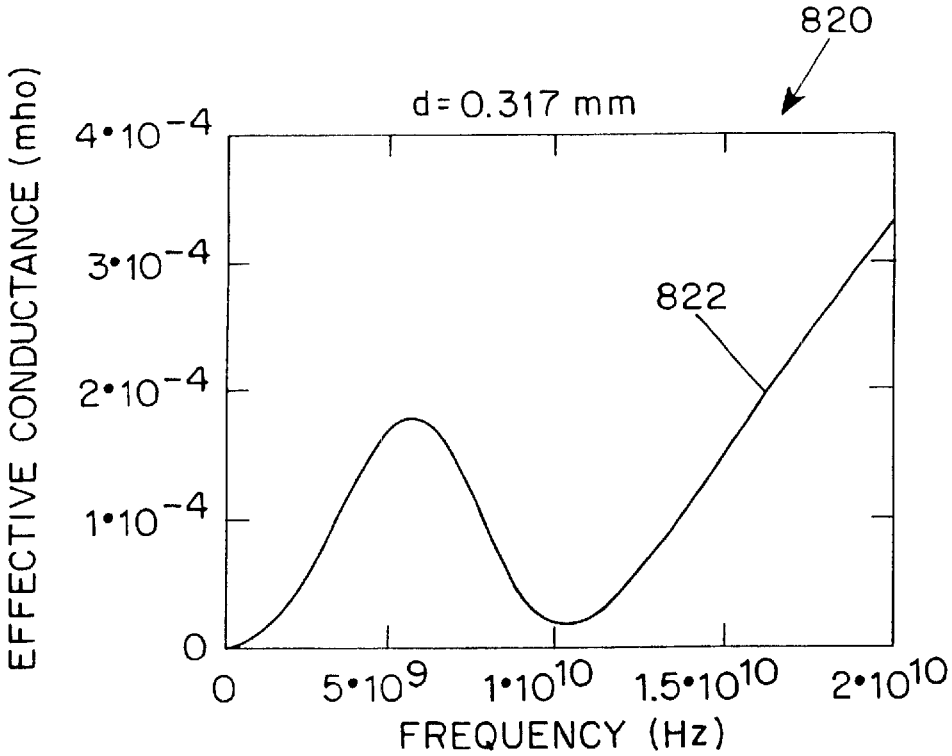

However, if the capacitive iris 740 is a resistive "cup" filled with a metal-ammonia solution as described above, then the resistance of the metal-ammonia solution is in parallel with the resistance of the cup. Assuming the cup has a surface resistance on the order of 600 ohms/square, the complex capacitance can be calculated and the effective conductance of the iris determined. FIGS. 8A and 8B show the results of the calculation of the effective conductance of the capacitive iris of FIGS. 8A and 8B when filled with metal-ammonia liquid. The effective conductance, which is proportional to attenuation, is shown in FIGS. 8A and 8B for 83 micron wide iris and a 0.317 mm wide iris, respectively. The plots 810 and 820 show that a lossy obstacle is obtained having a transparency window centered at approximately 10 GHz. The thickness (cup width) of metal-ammonia coating thus determines the width and depth of the conductivity bandwidth or transparency window.

Further with reference to FIGS. 8A and 8B, the case corresponding to FIG. 8A is equivalent to a material whose attenuation constant drops by a factor of 8 over 2 GHz, whereas in FIG. 8B the attenuation constant drops by a factor of 10 over 4.5 GHz. The mock-up of FIG. 6 verifies that sharp windows can be obtained by using high polarizability inclusions, such as strips or slivers, instead of the simple spheres of FIG. 3. Thus, the shape of the window is tuned by a proper choice of coating thickness, coated particle resistivity and even the coated particle's geometry. Low pass filter behavior of the material is prevalent with low aspect ratio spherical particulates, whereas passband characteristics are more prevalent with higher aspect ratio inclusions such as with ellipsoidal particles or strips.

Figure 9A:
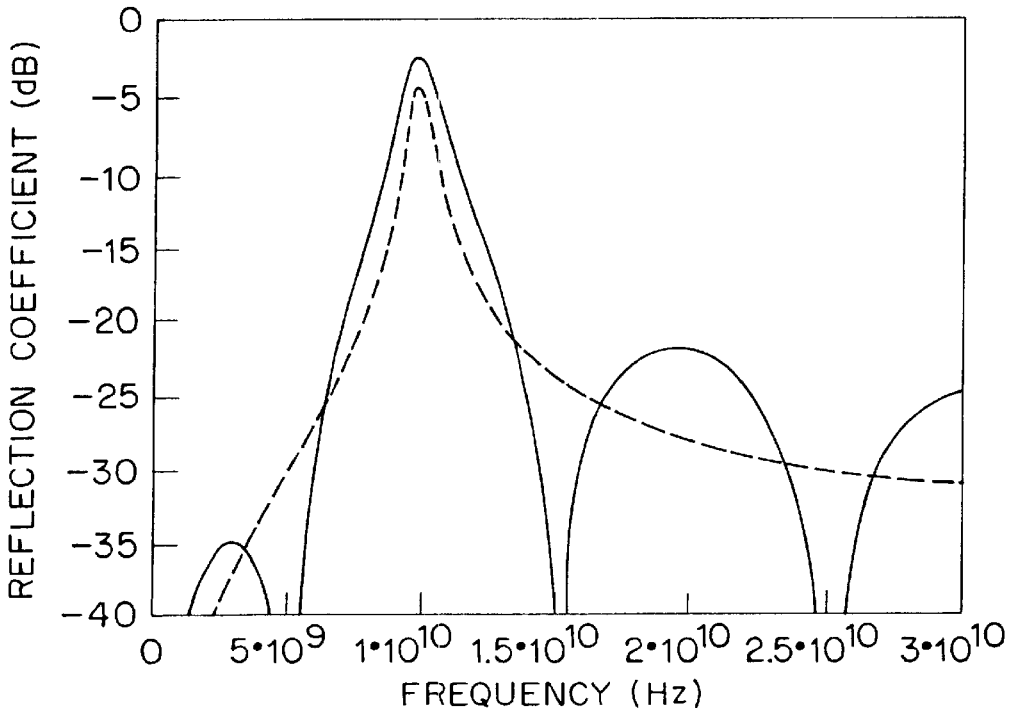
FIGS. 9A and 9B are plots of the narrowband reflectivity of a thin layer structure utilizing the lossy particles of FIG. 3 coated with a liquid metal-ammonia NARMET material.
Figure 9B:
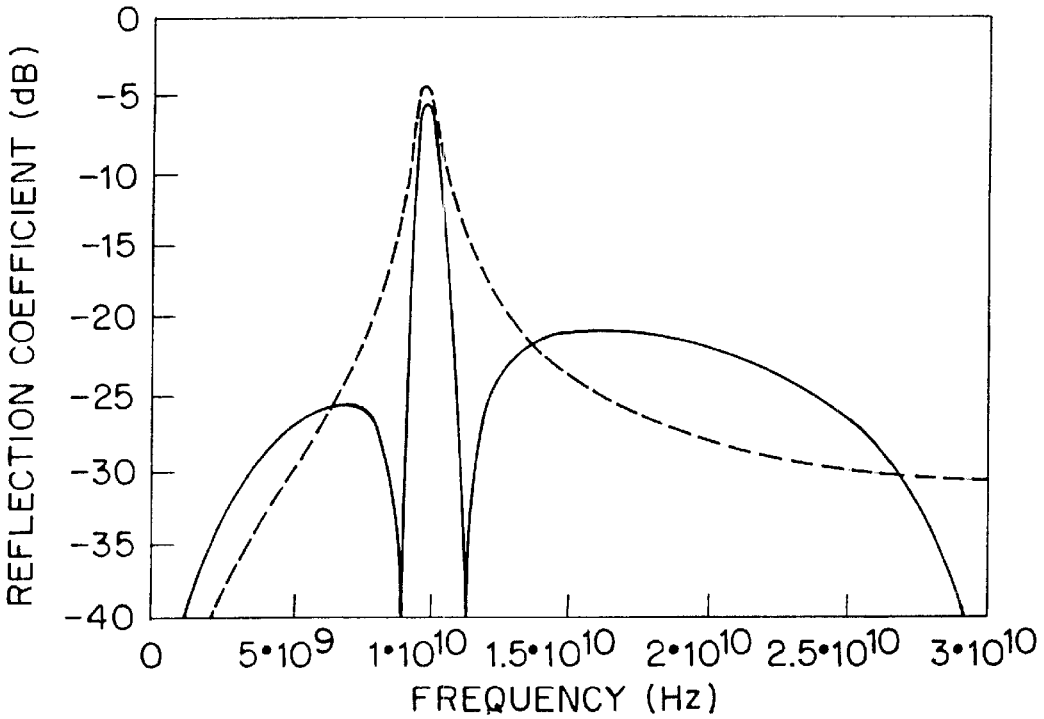

FIGS. 9A and 9B show plots of the narrowband reflectivity of a thin NARMET coating of liquid metal-ammonia. FIG. 9A shows the calculated reflection coefficient from a single NARMET coating 31 microns thick (dashed line) and the reflection coefficient when two such coatings are separated by a low dielectric constant dielectric, e.g., foam or honeycomb, one half wavelength thick at 10 GHz (solid line). The reflection coefficient is higher than the single coating's by about 2 dB while the reflection coefficient drops by −15 dB approximately 2.6 GHz about the resonance. Alternatively, if the coatings are held one quarter wavelength apart, 0.5 dB is lost from the peak value of the reflection coefficient but the −15 dB drop occurs 0.8 GHz about the resonance, as shown in FIG. 9B.

Comparably narrow reflection coefficients can be obtained with arrays of printed dipoles. See, e.g., B. A. Munk, R. G. Kouyoumjian, L. Peters, "Reflection Properties of Periodic Surfaces of Loaded Dipoles", *IEEE Trans. Antennas and Propagation*, vol. AP-19, no. 5 (September 1971); C. J. Larson and B. A. Munk, "The Broad-band Scattering Response of Periodic Arrays", *IEEE Trans. Antennas and Propagation*, vol. AP-31, no. 2, pp. 261–267 (March 1983). However, in all cases, additional reflective bands arise at harmonic frequencies. In addition, all methods employing dipole arrays suffer from the appearance of grating lobes above the first harmonic. The grating lobes and Wood's anomalies are related to the scan dependence of the dipole elements' impedance. Thus, considerable effort is devoted to ensuring that the frequency of peak reflectivity is independent of angle of illumination. In the present invention, because the material's resonance is chemical in nature, it does not change with the angle of incidence of the electromagnetic wave nor does it exhibit harmonic bands.

A narrowband metal may be applied with benefit to any device or system that normally uses metallic components for the guidance, concentration or radiation of electromagnetic waves over a narrow range of frequencies, whenever the absence of those metallic components at another frequency would be a desirable means to achieve tighter packaging, reduced interference, or some other substantially different electromagnetic response that would be impossible if the metal were still present. The following examples are illustrative but not exhaustive of this general application principle and are given to instruct one versed in the art in the general method of application of this invention. All the applications discussed in this patent application have one principle in common, namely that if the material has a natural resonant frequency, then the sharpness of that resonance can be amplified for practical purposes by incorporating the material into a structure that has the same resonant frequency.

Referring again to FIG. 1A, the microwave device 100 shown in the figure is an example of a highly transmissive device in accordance with the present invention. The device 100 includes a plurality of antennas 112 and 122 (only two shown) each for receiving and/or transmitting signals at an assigned frequency or frequency range. Each of the antennas 112 and 122 is covered with a corresponding shroud or radome 110 and 120 made of a NARMET coated particles composite as shown in FIG. 3 having a Lorentz resonance corresponding to the assigned frequency or frequency range of the corresponding antenna. Each of the radomes 110 and 120 thus appears transparent to signals at the assigned frequency or frequency range, but remains a barrier to frequencies outside the assigned frequency or frequency range for the corresponding antenna. Thus, interference between adjacent antennas is reduced.

Figure 10:
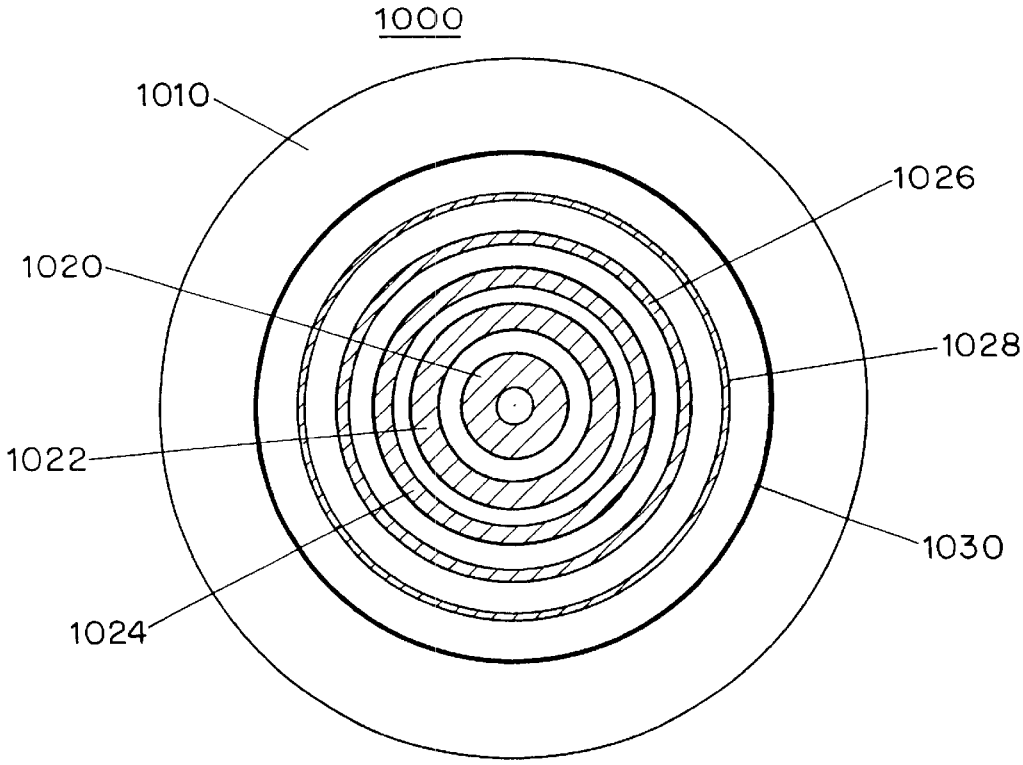
FIG. 10 is a front view illustration of a high directive gain antenna incorporating a NARMET hemispherical Fresnel zone plate as a diffraction lens.

FIG. 10 shows a front view illustration of a high directive gain antenna incorporating a NARMET hemispherical Fresnel zone plate as a diffraction lens. The antenna of FIG. 10 is an example of a highly conductive (reflective) device which includes a hemispherically-shaped dielectric shell 1010, a Fresnel zone plate formed on the shell 1010, and an elementary dipole radiator and/or receiver (not shown in FIG. 10). The Fresnel zone plate includes a plurality of concentric diffraction rings 1020 through 1030 formed of thin NARMET material formed directly on the dielectric shell 1010.

Figure 11:
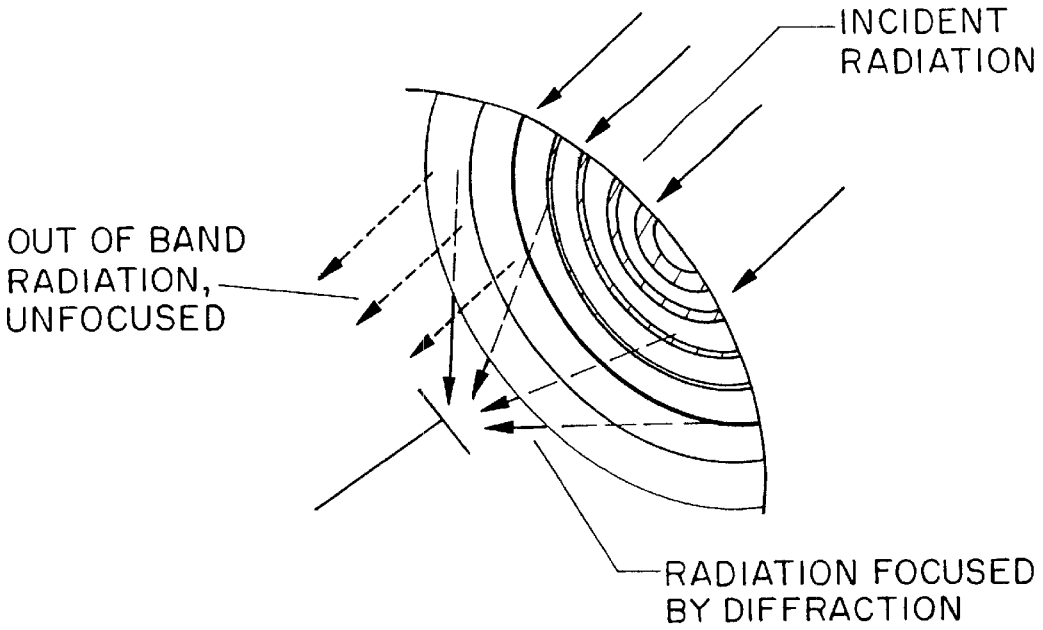
FIG. 11 is an illustration showing the operation of the high directive gain antenna of FIG. 10.

FIG. 11 illustrates the operation of the high directive gain antenna of FIG. 10. As shown in FIG. 11, when incident radiation is within the conductivity bandwidth of the Fresnel zone plate, the rings 1020 through 1030 of the Fresnel zone plate become "metallic" thus causing the radiation within the conductivity bandwidth to be diffracted onto the radiating dipole 1110 as if where diffracted off a true metallic surface. Out-of-band radiation however passes through the zone plate and remains unfocused. In a preferred embodiment of the antenna, the Fresnel zone plate is constructed and arranged for operation at 10 GHz.

As such, the antenna of FIGS. 10 and 11 can be used as a transmit and/or receive antenna for radar applications operating over a desired frequency band, e.g., 10 GHz, and to be as undetectable outside its band of operation. In a radar tracking system, for example, the Fresnel zone plate is used as a diffraction lens to focus the return echo from a target onto the receiving antenna. The directive gain of such a lens is typically 3 dB below the theoretical maximum corresponding to the cross sectional area of the lens, which in practice is on the order of 20 to 30 dB. Ordinarily, the Fresnel zone plates will focus other frequencies outside the desired frequency band, albeit with different focal lengths, therefore their high transmission gain would normally also imply a high reflected gain to incoming signals outside the band of operation and therefore a large out-of-band radar cross section (RCS). Constructing the Fresnel zones plates using the NARMET material in combination with the dielectric shell, however, minimizes this out-of-band echo and because the zones are essentially nonconductive, and therefore non-diffractive, at the out-of-band frequencies. Without the opaque Fresnel zones, the lens appears as just a thin dielectric plate whose radar cross section can be made vanishingly small through a variety of schemes, for example, shaping. Thus, in the absence of the metal bands in the out-of-band frequencies, the radar cross-section of such a shell is small and difficult to detect and identify.

With respect to another preferred embodiment of the present invention. frequently it is desirable to obtain power at a microwave frequency through the up- conversion from lower frequencies, e.g., generation of millimeter wave power 35 GHz to 100 GHz from microwave power in the 10 GHz to 20 GHz range. Nonlinear devices able to generate these higher frequencies through the second, third, and higher harmonics of the incident wave are well known. However, the transmission line used to guide the lower frequency microwave power is usually not suitable for the higher frequency wave. In particular, the ohmic loss of metals makes purely dielectric waveguides imperative for the guidance of millimeter waves, whereas a metallic waveguide or transmission line and resonant cavity are usually most desirable to guide and control the interaction of the lower frequency wave with the non-linear device. Therefore, a device in accordance with the preferred embodiments shown in FIGS. 12A through 12C, taking advantage of a narrowband metal material, is used to combine the input transmission line with the output transmission line into a single compact device.

Figure 12A:
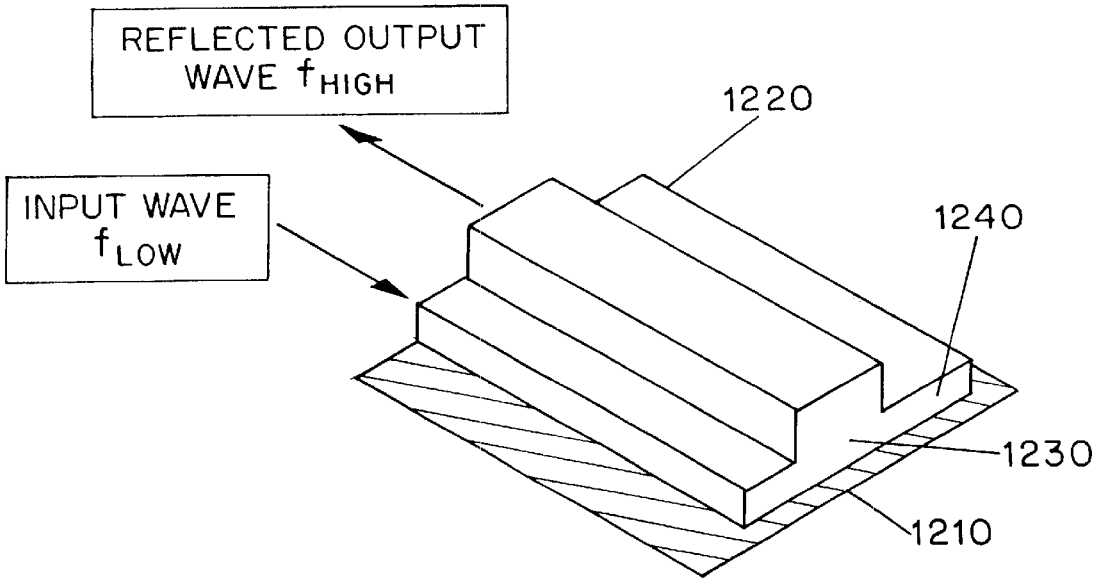
FIGS. 12A through 12D show perspective and side views of microwave frequency converter, waveguide and radiator devices in accordance with preferred embodiments of the present invention.

FIG. 12A shows a perspective view of a microwave frequency converter as a modified microstrip device 1200 in accordance with a preferred embodiment of the present invention. The microstrip 1200 includes a two-conductor transmission line 1210, 1220 for inputting low frequency power and a dielectric image line (inverted "T" shape) 1240 having an up-converting element or portion 1230 for up-converting and reflecting the up-converted power. A first of the two conductors is a common ground plane 1210, and the second is a NARMET layer 1220 disposed on top of the dielectric image line layer 1240. The NARMET layer 1220 coating the image line 1240 thus forms the upper conductor of the microstrip configuration capable of guiding the low frequency power at frequency $f_{low}$ in towards the upconverting device. After up-conversion to a signal having a frequency $f_{high}$, a frequency $f_{high}$ which is out of the conducting band of the narrowband metal, the narrowband metal coating is essentially invisible to the high frequency wave at frequency $f_{high}$. In particular, if the dielectric substrate is chosen to have a dielectric constant of the order of 15, i.e., close to the dielectric constant of the exemplary liquid ammonia NARMET, the NARMET coating 1220 is essentially an indistinguishable component of the dielectric image line 1240. The high frequency wave can thus travel along the dielectric image line 1240 with little if any loss.

Figure 12B:
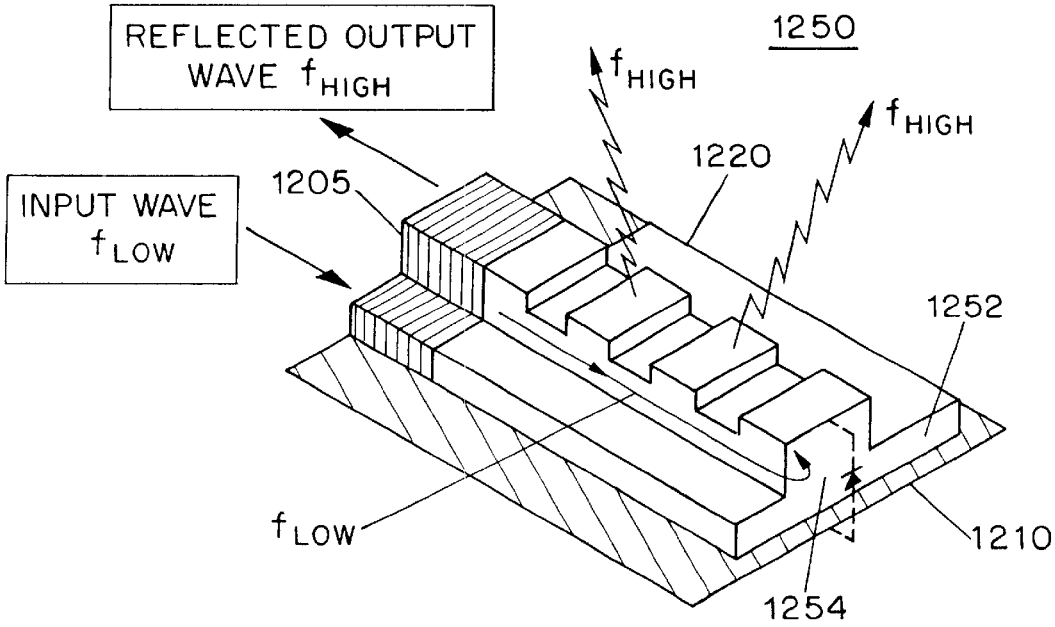
Figure 12C:
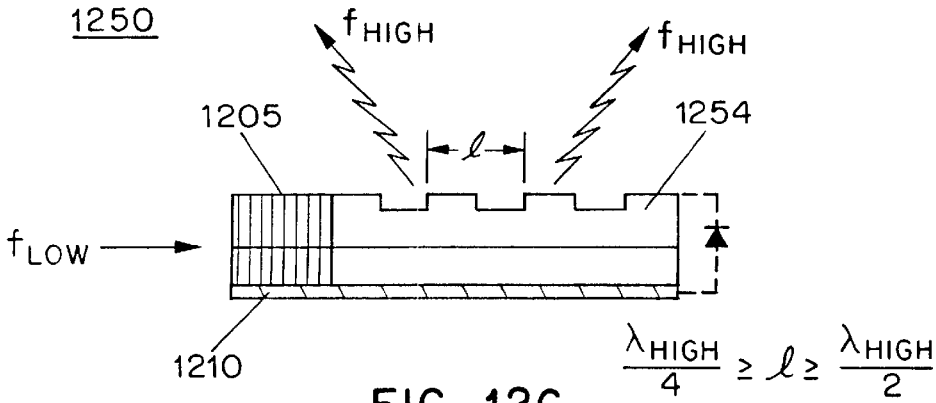

FIGS. 12B and 12C show perspective and side views, respectively, of an alternative embodiment 1250 of the microstrip device of FIG. 12A constructed and arranged for radiating millimeter wave power. As shown, the dielectric image line layer 1252 includes a "corrugated" up-converting element or portion 1254 having alternating up and down steps along the direction of propagation so as to turn the guided up-converted wave $f_{high}$ into a leaky wave radiating in a prescribed direction of space. Because such corrugations have a spatial frequency above the frequency of operation of the low frequency transmission input line 1205, the corrugations are seen by the low frequency wave simply as capacitive loading ridges, causing a local slowing of the wave but no radiation. The input line 1205 can be a conventional metal coating for guiding the incoming low frequency wave at frequency $f_{low}$. Thus, a compact high frequency radiating structure is provided having the input line 1205 and the corrugated up-converting element 1254.

Figure 12D:
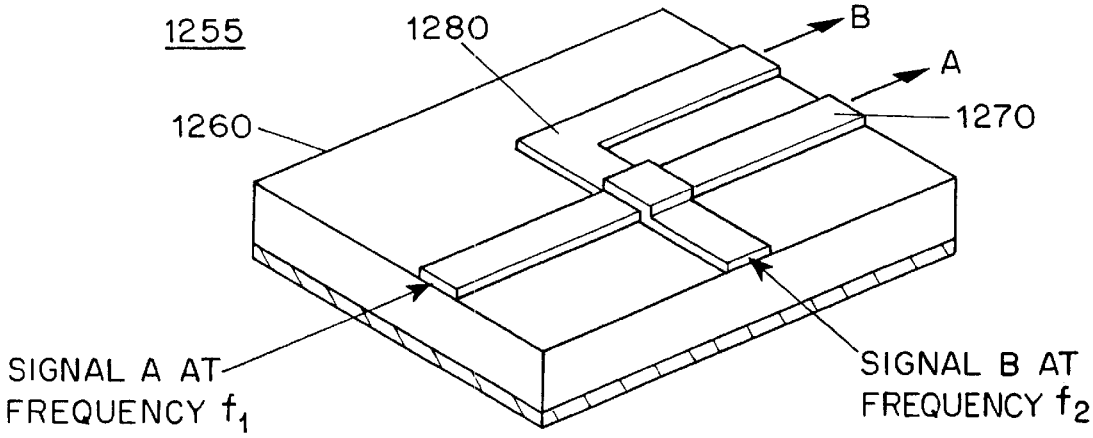

FIG. 12D shows another embodiment of a microstrip device 1255 in accordance with the present invention. As shown in FIG. 12D, two or more microstrips 1270 and 1280 (only two shown) comprised of different narrowband metal materials are disposed on a dielectric substrate 1260. The dielectric substrate 1260, as in the preferred embodiments of FIGS. 12A through 12C, is disposed on a metallic ground plane 1210. Each of the mirostrips 1270 and 1280 are tuned a different corresponding frequency or frequency ranges, and as such the device can be used to achieve even higher levels of compactness. As shown in FIG. 12D, for example, the two microstrips 1270 and 1280 are constructed and arranged so as to propagate two different signals at two different frequencies without leakage from one microstrip to the other. Thus a signal A at frequency $f_1$ can be transmitted on microstrip 1270 without cross-coupling with signal B at frequency $f_2$ on microstrip 1280.

Figure 13:
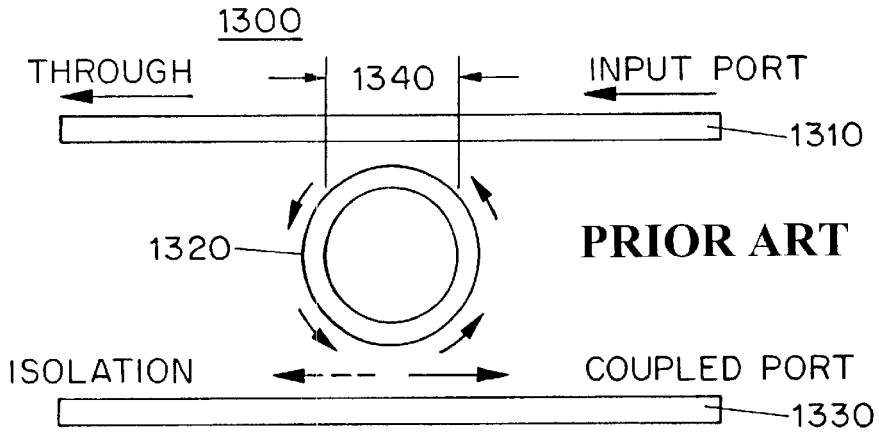
FIG. 13 is an illustration of a conventional ring coupler constructed and arranged for filtering and coupling microwave signals.
Figure 14:
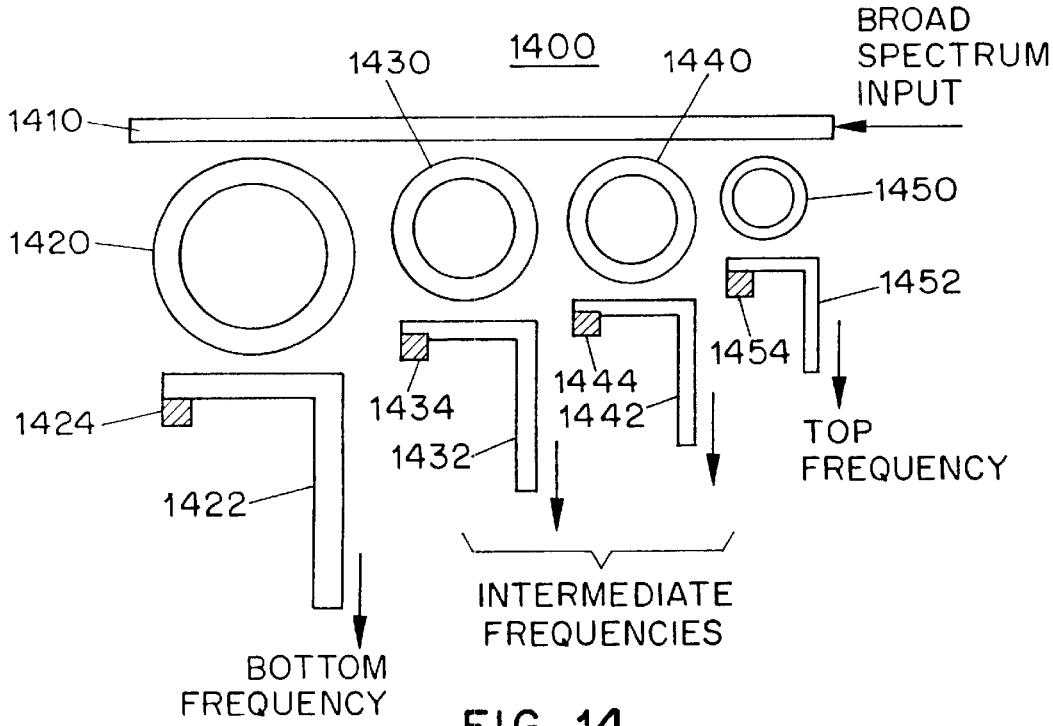
FIG. 14 is an illustration of an extremely narrowband frequency filter/coupler in accordance with a preferred embodiment of the present invention.
Figure 15:
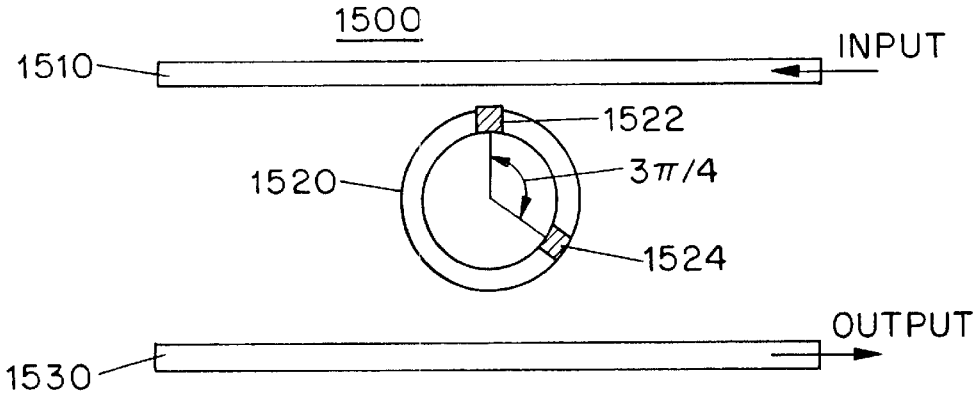
FIG. 15 is an illustration of a modified narrowband frequency filter/coupler in accordance with an preferred embodiment of the present invention.

FIGS. 13 through 15 are further "high conductivity" embodiments of the present invention wherein a NARMET material filters out a signal at one frequency while leaving signals at all other frequencies unaffected. FIG. 13, for example, shows an overhead view of a ring coupler 1300 constructed and arranged for filtering and coupling a signal of a specific frequency from one microstrip circuit to another. Such a ring coupler, for example, can be used along with a broad band antenna such as a spiral antenna for anti-radiation homing and generally for receiving signals over a very broad band of frequencies which must be separated to be analyzed and identified. The ring coupler 1300 is exemplified, in which a signal traveling along an input strip transmission line 1310 is coupled over a portion of its length to a ring resonator 1320 which is itself coupled the same way to an adjacent coupled transmission line 1330. Depending on the distance between the edge of the ring resonator 1320 and the transmission lines 1310 and 1330, and the length of the interaction region 1340, the amount of energy coupled to and from the ring can be controlled. The ring resonator 1320 is constructed using a NARMET material having a resonant frequency, i.e., frequency of high conductivity, corresponding to the frequency at which the ring is one wavelength in circumference. The ring resonator 1320 thus serves to couple the signals at the resonant frequency signals from one transmission line to the other. At all other frequencies, however, the ring resonator 1320 is essentially transparent and the transmission lines are thus totally uncoupled from each other due to the large distance between them. The same reasoning applies if the NARMET frequency is made to match any of the other passband frequencies of the ring resonator 1320. Only that frequency is selected, and thus the ring coupler functions as an extremely narrow single band filter.

Extremely narrow band filters such as shown in FIG. 13 are a distinct improvement over narrow band filters because they allow closer packing in the spectrum of competing signals. That is, with a narrow band filter, two signals to be distinguished (or multiplexed) must have a minimum spectral separation between them, roughly corresponding to the 6 dB width of the filter's passband, i.e., this is why radio stations in the FM band are always 0.2 MHZ apart from each other. If the signals are closer in frequency, the signals can interfere with each other. Thus, an extremely narrowband filter allows the competing signals to be closer in the spectrum.

FIG. 14 shows an illustration of an extremely narrowband frequency filter/coupler 1400 arranged and constructed accordance with another preferred embodiment of the present invention. The filter/coupler 1400 of FIG. 14 includes a broad spectrum input transmission line 1410, a cascade arrangement of ring resonators 1420, 1430, 1440 and 1450, and a corresponding set of coupled transmission lines 1422, 1432, 1442 and 1452. In accordance with the present invention, the ring resonators 1420, 1430, 1440 and 1450 are constructed, at least in part, of a NARMET material. The transmission lines 1422, 1432, 1442 and 1452 are coupled to the broadband spectrum input transmission line 1410 via the cascaded ring resonators, which are used for selecting specific frequencies for a broad spectrum signal applied to the input transmission line 1410. Elements 1424, 1434, 1444 and 1454 are isolation resistors.

Furthermore, if the filter of the example were one of a cascade of rings that aims to separate several frequencies into different receivers, as shown in FIG. 14, it is clear that in the conventional approach there would be a loss of signal at every octave since more than one filter would draw out the signal (the fundamental and then the one twice as large via its first harmonic). With NARMET materials, however, each ring is a single band filter and thus no harmonics are drawn out. As such, the NARMET-based filter/coupler provide greater throughput, minimizes interference and increases the available bandwidth in the spectrum.

Preferably, only certain portions of the ring resonators of FIGS. 13 and 14 are constructed using the above-described NARMET materials so as to prevent the undesired resonance of the ring resonators at the harmonics of the desired (fundamental) frequency. Therefore, as shown in FIG. 15 by way of example and not limitation, if a ring resonator is desired that filters a specific frequency out of a two octave bandwidth, each of the ring resonators can be designed to include two NARMET segments 1522 and 1524, which effectively "chop up" the resonator ring into three disconnected segments incapable of resonating at any of the frequencies other than the resonant frequency of the NARMET segments 1522 and 1524. The NARMET segments 1522 and 1524, which become open circuited gaps in the ring out-of-band, thus function as mode filters since it becomes impossible for a wave to establish a resonant pattern of nodes and anti-nodes that is commensurate with the position of the gaps. In other words, the ring resonator must include an integer number of half-wavelengths along every continuous portion of its circumference. In contrast, a ring device having multiple sections whose lengths are fractions or a non-integer multiples of half-wavelengths of the desired frequencies would not resonate.

In summary, each of the above-described NARMET applications has been selected to highlight one such application wherein narrowband metals lead to novel devices, with potentially simple (low cost) implementation. The above- described examples may provide the impetus for further study and development of materials capable of being tuned to arbitrary frequencies in the microwave range. Such materials would constitute a breakthrough in the design and manufacture of microwave devices for use in military and commercial applications.

Although the present invention has been described in connection with particular embodiments thereof, it is to be understood that such embodiments are susceptible of modification and variation without departing from the scope of the inventive concept as defined by the appended claims.

What is claimed is:

1. A microwave device operating at a selected frequency band or group of selected frequency bands of interest, said device comprising a resonant bulk material itself comprising a narrowband metal material having one or more conductivity bandwidths defined by one or more Lorentz resonance frequencies within the selected frequency band or group of selected frequency bands of interest, wherein said narrowband metal material exhibits conductive properties at a frequency or frequencies within said one or more conductivity bandwidths and non-conductive properties at all other frequencies.

2. The device according to claim 1, wherein said device is a highly transmissive microwave device.

3. The device according to claim 2, wherein said resonant bulk material comprises:

lossy material particles arranged for absorbing radiation at frequencies outside said one or more conductivity bandwidths; and a resonant coating of said narrowband metal material around said lossy material particles.

4. The device according to claim 3, wherein said resonant coating is a liquid metal-ammonia.

5. The device according to claim 4, wherein said liquid metal ammonia is lithium ammonia ($Li—NH_3$).

6. The device according to claim 3, further comprising:

a plurality of antennas each operating at a corresponding assigned frequency range;

a covering for each of said antennas, each of said coverings comprising said narrowband metal material having a Lorentz resonance frequency corresponding to the assigned frequency such that each of said coverings appears transparent to signals having a frequency within the assigned frequency range for the corresponding one of said antennas.

7. The device according to claim 1, wherein said device is a highly conductive microwave device.

8. The device according to claim 7, further comprising narrowband metal material substructures on the order of one-half the size of the wavelength of the selected frequency band or group of selected frequency bands of interest.

9. The device according to claim 7, further comprising:

a dielectric shell structure;

an antenna; and a Fresnel zone plate disposed on said shell structure, said Fresnel zone plate comprising a plurality of concentric rings constructed using said narrowband metal material for focusing radiation corresponding to the selected frequency band or group of selected frequency bands of interest onto or from said antenna.

10. The device according to claim 7, further comprising:

a metal conductor layer;

a dielectric image line layer disposed on top of said metal conductor having at least one lower portion and at least one upwardly extending portion; and a narrowband metal layer disposed on top of said dielectric image line layer, wherein said narrowband metal layer together with said at least one lower portion of said dielectric image line layer and said metal conductor layer forms a first transmission path for a first signal having a first frequency, and wherein said narrowband metal layer together with said dielectric image line layer and said metal conductor layer forms a second transmission path for a second signal having a second frequency.

11. The device according to claim 10, wherein said upwardly extending portion of said dielectric image line layer is corrugated.

12. The device according to claim 7, further comprising:

a metal conductor layer;

a dielectric image line layer disposed on top of said metal conductor having at least one lower portion and at least one upwardly extending portion; and two or more microstrip portions disposed on top of said dielectric image line layer each comprising a different narrowband metals tuned to two or more corresponding different frequencies.

13. The device according to claim 7, further comprising:

a first strip transmission line for providing a input signal having frequency within a first frequency band;

at least one ring resonator coupled to a portion of said first strip transmission line, said at least one ring resonator being constructed at least in part of said narrowband metal material and having a resonant frequency corresponding to the selected frequency band or group of selected frequency bands of interest; and at least one second transmission line having a portion thereof coupled to said at least one ring resonator for providing one or more output signals each having a frequency corresponding to the selected frequency band or group of selected frequency bands of interest.

14. The device according to claim 13, wherein said at least one ring resonator is constructed entirely of said narrowband metal material.

* * * * *

UNITED STATES PATENT AND TRADEMARK OFFICE

CERTIFICATE OF CORRECTION

PATENT NO. : 6,473,048 B1
DATED : October 29, 2002
INVENTOR(S) : Diaz

It is certified that error appears in the above-identified patent and that said Letters Patent is hereby corrected as shown below:

Title page,
Item [56], References Cited, OTHER PUBLICATIONS, under Kyriazidou et al., "Windonw" should read -- Window --

Column 2,
Line 46, "includes" should read -- including --

Column 3,
Line 4, "a" (second occurrence) should be deleted

Column 4,
Line 2, "e.g," should read -- e.g., --
Line 57, "MHZ" should read -- MHz --

Column 5,
Line 3, "substructures" should read -- substructures, --

Column 6,
Line 25, "$\in_{inc}$" should read -- $\varepsilon_{inc}$ --
Line 26, "$\in_{matrix}$" should read -- $\varepsilon_{matrix}$ --
Line 30, "3" should read -- 3 --
Line 31, "p" should read -- ρ --
Line 49, "a" should be deleted
Line 55, "∈"" should read -- ε" --

Column 7,
Lines 29 and 32, "Equation (3):" should read -- Equation (4): --
Line 43, "Equation (4):" should read -- Equation (5): --

Column 9,
Line 16, "hemispherically-shaped" should read -- hemispherically shaped --
Line 43, "cross sectional" should read -- cross-sectional --

Column 10,
Line 65, "mirostrips" should read -- microstrips --

UNITED STATES PATENT AND TRADEMARK OFFICE

CERTIFICATE OF CORRECTION

PATENT NO. : 6,473,048 B1
DATED : October 29, 2002
INVENTOR(S) : Diaz

It is certified that error appears in the above-identified patent and that said Letters Patent is hereby corrected as shown below:

Column 11,
Line 49, "MHZ" should read -- MHz --

Column 12,
Line 11, "provide" should read -- provides --.

Signed and Sealed this

Twenty-fourth Day of June, 2003

JAMES E. ROGAN
*Director of the United States Patent and Trademark Office*